US008633887B2

(12) United States Patent
Lim

(10) Patent No.: US 8,633,887 B2
(45) Date of Patent: Jan. 21, 2014

(54) DATA DRIVE IC OF LIQUID CRYSTAL DISPLAY AND DRIVING METHOD THEREOF

(75) Inventor: Kyoung Moon Lim, Gwangmyeong-si (KR)

(73) Assignee: LG Display Co., Ltd., Seoul (KR)

( * ) Notice: Subject to any disclaimer, the term of this patent is extended or adjusted under 35 U.S.C. 154(b) by 2055 days.

(21) Appl. No.: 10/865,764

(22) Filed: Jun. 14, 2004

(65) Prior Publication Data

US 2004/0257328 A1 Dec. 23, 2004

(30) Foreign Application Priority Data

Jun. 23, 2003 (KR) ..... 10-2003-0040546

(51) Int. Cl.
*G09G 3/36* (2006.01)

(52) U.S. Cl.
USPC ..... 345/100; 345/89

(58) Field of Classification Search
USPC ..... 345/88, 89, 690, 698
See application file for complete search history.

(56) References Cited

U.S. PATENT DOCUMENTS

| | | | | |
|---|---|---|---|---|
| 6,577,293 | B1 * | 6/2003 | Kwon | 345/89 |
| 6,665,453 | B2 * | 12/2003 | Scheurich | 382/298 |
| 6,771,319 | B2 * | 8/2004 | Konuma | 348/584 |
| 6,839,043 | B2 * | 1/2005 | Nakajima | 345/87 |
| 7,061,456 | B2 * | 6/2006 | Hiyama et al. | 345/87 |
| 2002/0063674 | A1 | 5/2002 | Chiang | |

* cited by examiner

*Primary Examiner* — Duc Dinh
(74) *Attorney, Agent, or Firm* — McKenna, Long & Aldridge, LLP.

(57) ABSTRACT

A data driver IC of a liquid crystal display is provided. The data driver IC includes: a shift register; a latch part in which input digital data are sampled by the shift register and stored, the latch part including a plurality of latches; a digital to analog converter and an amplifier for converting the sampled digital data into an analog signal and amplifying the analog signal; an analog signal supplying part for generating first and second analog voltages corresponding to a black signal level and a white signal level, respectively; a color conversion control signal supplying part for controlling whether to display the input digital data in full colors or 8-bit color; a selector for selecting and outputting one of the first analog voltage corresponding to the black signal level and the second analog voltage corresponding to the white signal level; and a multiplexer for receiving the output analog signal and transferring the output analog signal to a corresponding data line.

7 Claims, 7 Drawing Sheets

DATA DRIVE IC OF LIQUID CRYSTAL DISPLAY AND DRIVING METHOD THEREOF

This application claims the benefit of Korean Patent Application No. 2003-40546 filed on Jun. 23, 2003, which is hereby incorporated by reference for all purposes as if fully set forth herein.

BACKGROUND OF THE INVENTION

1. Field of the Invention

The present invention relates to a liquid crystal display, and more particularly, to a data driver IC of a liquid crystal display and a driving method of the data driver IC.

2. Description of the Related Art

Recently, liquid crystal displays (LCDs) are becoming widely used as an apparatus for displaying various images including a still picture or a moving picture, and their applications are expanding due to improvements in picture quality achieved by using an improved liquid crystal material and the development of better pixel processing techniques. LCD displays also have the advantages of light weight, thin profile, and low power consumption.

An active matrix LCD (AM-LCD) generally includes an array substrate including a lower substrate of a liquid crystal panel for image display. On the array substrate, a plurality of pixels are arranged in a matrix configuration, a plurality of thin film transistors (TFTs) functioning as a switching element are also formed, and a plurality of gate lines and a plurality of data lines crossing the plurality of gate lines are arranged.

FIG. 1 is a block diagram of a related art AM-LCD.

Referring to FIG. 1, the related art AM-LCD includes a data driver IC 3 for providing a liquid crystal panel 6 with image data from an external video card 1, a gamma voltage IC 4 for supplying a signal voltage to the data driver IC 3, a gate driver IC 5, which provides the liquid crystal panel 6 with a scanning signal for controlling the switching of thin film transistors of the liquid crystal panel 6, and a controller 2 for controlling the data driver IC 3 and the gate driver IC 5.

The liquid panel 6 with an XGA resolution (1024*768 pixels) level has 1024*3 (one for each of red, green, and blue) data lines. For instance, in an LCD with XGA resolution, 8 data driver ICs each having output terminals of 384 channels, and 4 gate driver ICs each having output terminals of 200 channels are used.

Video data provided by a video card built in a computer or another source is supplied to the data driver IC 3 via the controller 2. In another example, an analog image signal input by a computer is converted to digital video data through an interface module built in an LCD monitor, and the converted digital video data is input into the LCD.

The gate driver IC 5 applies a scanning pulse once per frame period to each scanning line, and timing of the scanning pulse is interlaced from an upper side of the liquid crystal panel toward a lower side. The data driver IC 3 applies a liquid crystal driving voltage, which corresponds to pixels of one row to which the scanning pulse is applied, i.e., a signal voltage to each data line.

In selected pixels to which the scanning pulse is applied, corresponding thin film transistors are turned on as voltages of corresponding gate electrodes connected to the gate line increase.

The liquid crystal driving voltage is applied to the liquid crystal from the data line via the drain electrode and the source electrode of each of the thin film transistors, so that each of the corresponding pixels charges a pixel capacitance corresponding to a sum of the liquid crystal capacitance and the storage capacitance. By repeating the operation, a voltage corresponding to an image signal is applied to a pixel capacitance of the liquid crystal panel repeatedly per frame FIG. 2 is a block diagram of the data driver IC of FIG. 1. In FIG. 2, it is assumed that external digital data has 6 bits for the convenience of this description.

Referring to FIG. 2, all bits of external digital data D5, . . . , D0 are sequentially sampled by a shift pulse in a first latch 22, and when the sampling ends, the data are transferred to a second latch 24 by a line pass signal at a time.

Next, the sampled digital data are converted into an analog image signal by a digital-to-analog converter (DAC) 26. The converted analog image signal is amplified by an amp, and transferred to data lines 28 of the liquid crystal panel.

In the related art LCD, a driving IC board, i.e., a board provided with a data driver IC and a gate driver IC, is installed separately from the liquid crystal panel.

However, as low temperature polysilicon is developed, allowing use of large-sized glass substrates, and the integration technology of driver ICs advances, it becomes possible to integrate circuits for processing the display signals on the glass substrate. In addition, the variety of circuits that can be integrated on the glass substrate increases.

In other words, the above system-on-LCD includes polysilicon TFTs formed on a glass substrate for use in both the pixel array and the driver IC of the liquid crystal panel. By doing so, the cost of fabricating a module in the fabrication of an LCD can be saved and the power consumption of the LCD is reduced.

FIG. 3 is a circuit diagram of a unit pixel region in a related art liquid crystal panel.

Referring to FIG. 3, a gate line 31 and a data line 32 crossing the gate line 31 are formed on a glass substrate. A thin film transistor (TFT) 33 connected to the gate line 31, and the data line 32 is formed near a crossing point of the gate line 31 and the data line 32. A drain electrode 33*d* of the TFT 33 is electrically connected with a pixel electrode of a liquid crystal cell 38.

An auxiliary capacitance 35 for maintaining a voltage of the pixel electrode 37 during one field period is also formed between the TFT 33 and the pixel electrode 37. One terminal 34 of the auxiliary capacitance 35 is connected to the drain electrode 33*d* of the TFT 33, and the other terminal 36 is connected to a common voltage Vcom commonly applied to the pixel electrode 37.

When a gate signal is applied to the gate line 31, the TFT 33 is turned on as aforementioned, and the analog image signal is transferred to the pixel electrode 37 via the data line 32 and maintained by the auxiliary capacitance 35. The image signal voltage transferred to the pixel electrode 37 is applied to the liquid crystal cell 38, thereby aligning the liquid crystal.

In the related art LCD, an image can be obtained regardless of whether the image is from a moving picture or a still picture. As an example of the still picture, a battery indicator image for displaying the power remaining in a battery of a handheld terminal is displayed on an LCD of the handheld terminal.

However, in the related art LCD, displaying the still picture, like displaying the moving picture, requires turning the TFT on using a gate signal and again inputting an image signal to each pixel electrode. To this end, the gate driver IC, the data driver IC, and a controller for controlling an operation timing of the driver ICs is always working, which increases the power consumption.

Accordingly, an LCD having a static memory device provided at each pixel has been used.

FIG. 4 is a circuit diagram of a unit pixel region of a liquid crystal panel having a related art maintenance circuit.

Referring to FIG. 4, pixel electrodes 37 are arranged in a matrix configuration on a substrate. For the convenience of description, only one pixel electrode is shown in the drawing. Data lines 32 are arranged in left and right sides of the pixel electrode, and gate lines 31 are arranged in upper and lower sides of the pixel electrode 37.

The maintenance circuit 42 utilizes a memory in which two-stage inverters are in a positive feedback arrangement. In other words, a static random access memory (SRAM) may be used as a maintenance circuit for the digital video signals. Particularly, unlike DRAM, SRAM is appropriate because it does not require a refresh operation for maintaining data.

To reproduce a still picture in 8 colors with the LCD of FIG. 4, only the SRAM added to the unit pixel operates. Accordingly, the driver ICs and an external module are inactivate, providing the liquid crystal panel with a low power consumption characteristic.

However, in the LCD having the unit pixel of FIG. 4, because the number of devices constituting the memory is high, apparatuses and processes capable of using a simplified design are needed. Also, although such an LCD can be achieved, it cannot be used in the transmission type LCD because it needs a layout throughout the whole area of the pixel regions.

SUMMARY OF THE INVENTION

Accordingly, the present invention is directed to a data driver IC of a liquid crystal display and a driving method of the data driving IC that substantially obviates one or more problems due to limitations and disadvantages of the related art.

An advantage of the present invention is to provide a data driver IC of a liquid crystal display and a driving method of the data driving IC in which a color conversion function is provided to the data driver IC, and when the LCD operates in an 8 color mode, 3 bit output signal is generated using only the most significant bit (MSB) among the supplied digital data, thereby greatly reducing power consumption without using most of drive ICs.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a data driver IC of a liquid crystal display. The data driver IC includes: a shift register; a latch part in which input digital data are sampled by the shift register and stored, the latch part including a plurality of latches; a digital to analog converter and an amplifier for converting the sampled digital data into an analog signal and amplifying the analog signal; an analog signal supplying part for generating first and second analog voltages corresponding to a black signal level and a white signal level, respectively; a color conversion control signal supplying part for controlling whether to display the input digital data in full colors or 8 color; a selector for selecting and outputting one of the first analog voltage corresponding to the black signal level and the second analog voltage corresponding to the white signal level; and a multiplexer for receiving the output analog signal and transferring the output analog signal to a corresponding data line.

In the above data driver IC, a moving picture is displayed in the full colors and a still picture is displayed in the 8 colors.

According to another aspect of the present invention, there is provided a method of driving a data driver IC of a liquid crystal display, the method including: sampling and storing input digital data; determining a color mode of an image for the input digital data; when the color mode is an 8 color mode, selecting only a MSB of the input digital data; and selecting and outputting an analog signal corresponding to a black signal level or an analog signal corresponding to a white signal level depending on whether the MSB is high or low.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
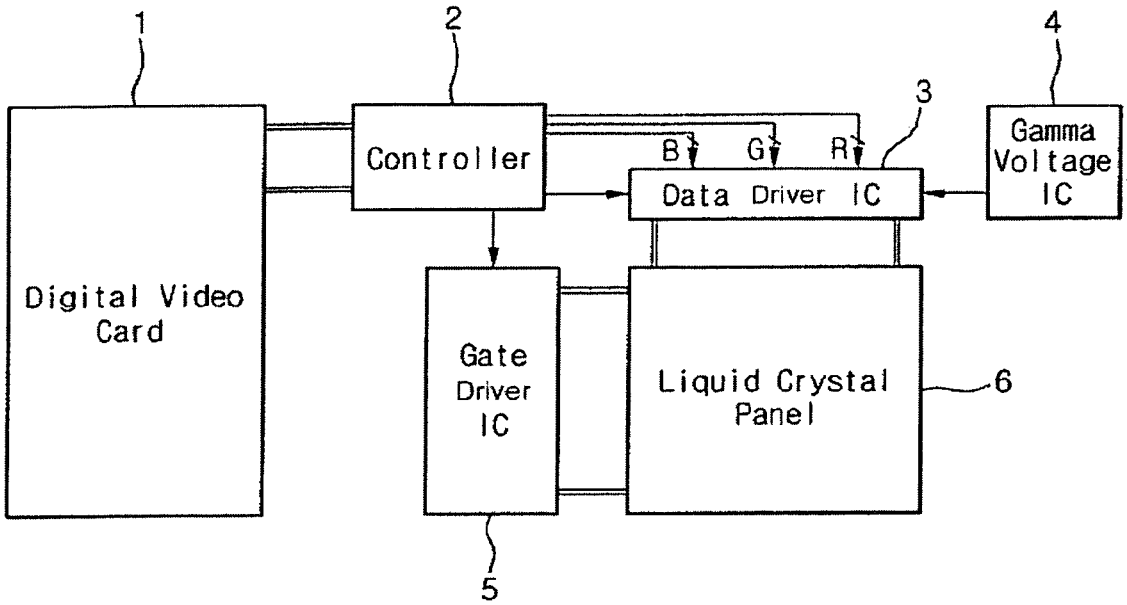
Fig.1 Related Art
FIG. 1 is a block diagram of a related art AM-LCD.
Figure 2:
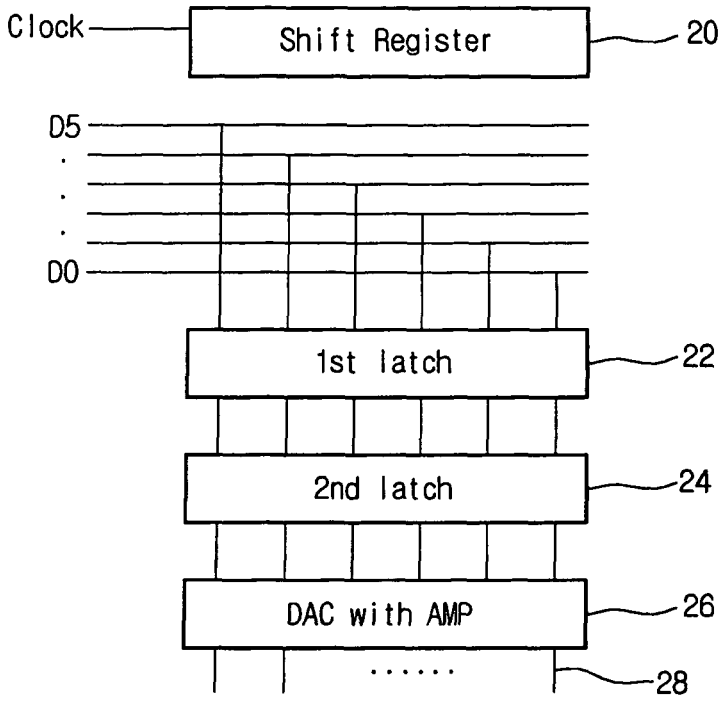
Fig.2 Related Art
FIG. 2 is a block diagram of the data driver IC of FIG. 1.
Figure 3:
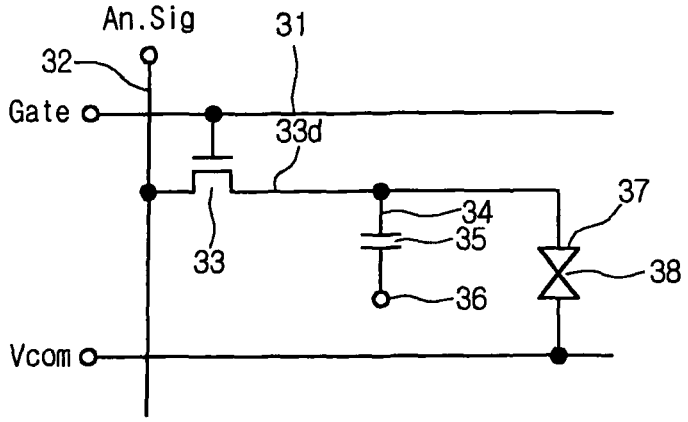
Fig.3 Related Art
FIG. 3 is a circuit diagram of a unit pixel region in a related art liquid crystal panel.
Figure 4:
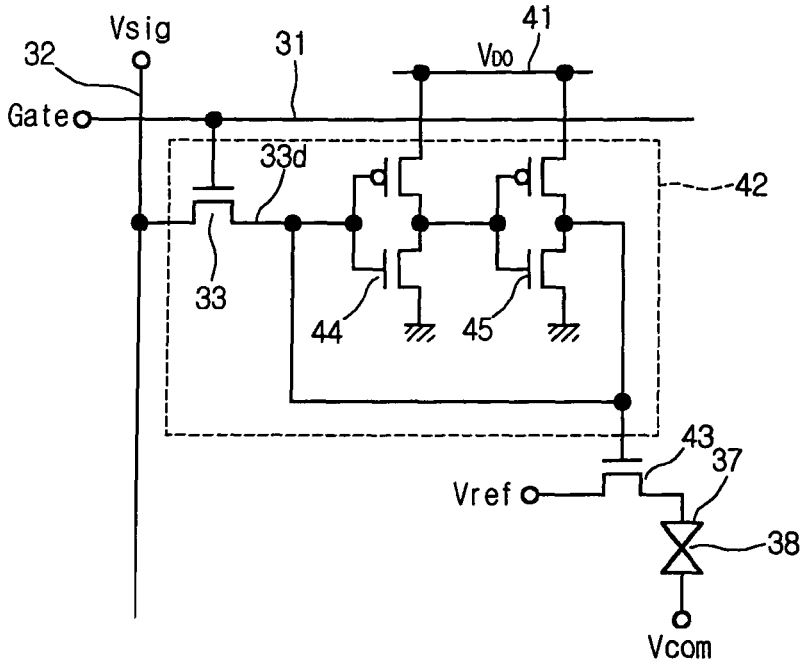
Fig.4 Related Art
FIG. 4 is a circuit diagram of a unit pixel region of a liquid crystal panel having a related art maintenance circuit.
Figure 5:
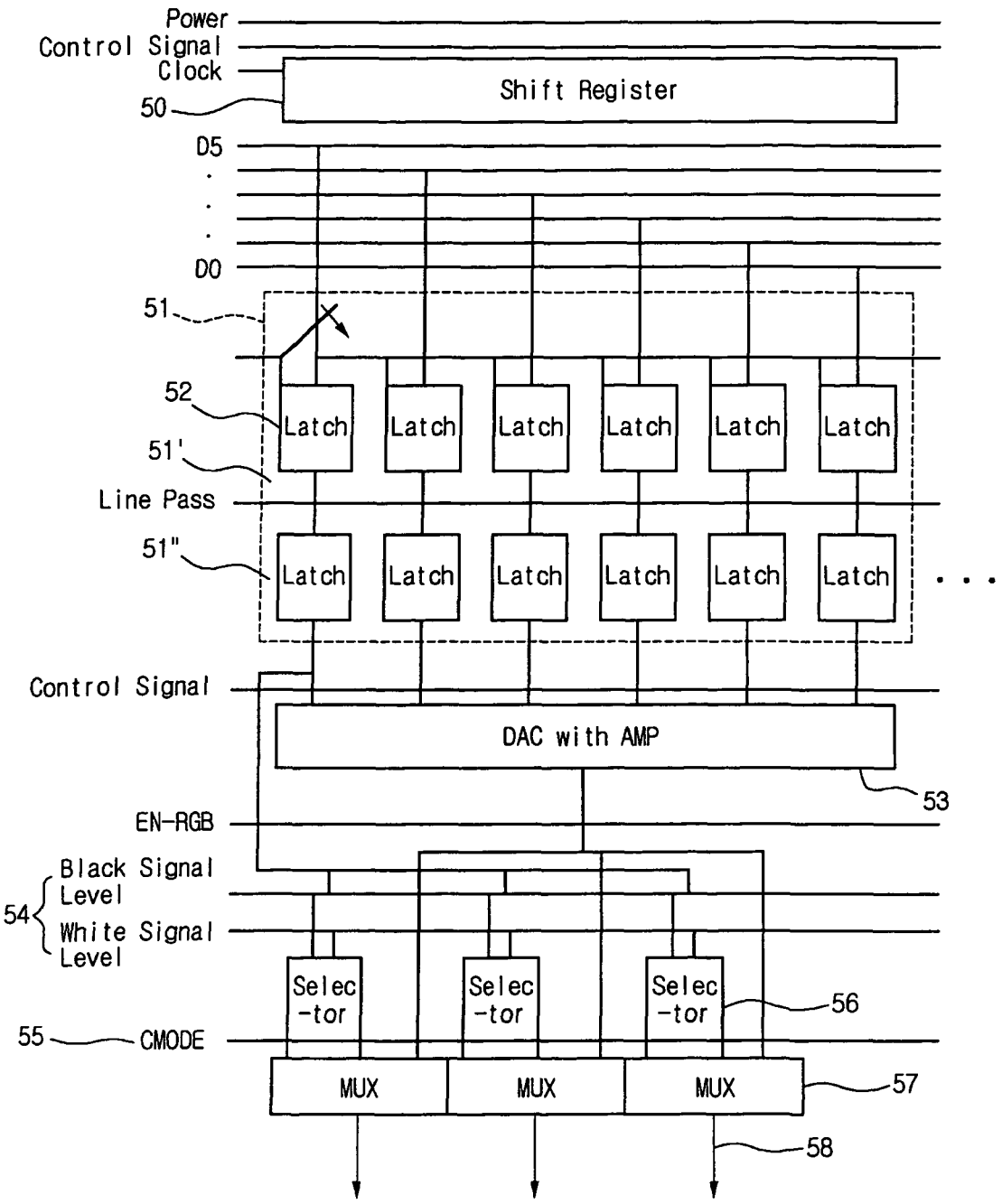
FIG. 5 is a block diagram of a data driver IC according to an embodiment of the present invention.

FIG. 5 is a block diagram of a data driver IC according to an embodiment of the present invention.

It is assumed that the data driver IC is formed on the same substrate as a pixel array of a liquid crystal panel. However, other embodiments are contemplated in which the driver IC is formed on a different layer than the pixel array. For this purpose, an active layer of a thin film transistor (TFT) formed on the substrate is formed of polysilicon. For the convenience of this description, it is assumed that the input digital data has 6 bits.

Referring to FIG. 5, the data driver IC according to the present invention includes a shift register 50, a latch part 51, a digital-to-analog converter (DAC) and an amplifier 53, an analog signal supplying part for generating analog voltages corresponding to a black signal level and a white signal level, respectively, a color conversion control signal supplying part (CMODE) 55 for controlling whether to display the input digital data in full colors or 8 color, a selector 56 for selecting and outputting one of an analog voltage corresponding to the black signal level and an analog voltage corresponding to the white signal level, a multiplexer (MUX) 57 for receiving the output analog signal and transferring the output analog signal to a corresponding data line 58.

A moving picture may be displayed in full color and a still picture may be displayed in 8-bit color.

The latch part 51 is configured with a plurality of latches 52. The latch part 51 includes: a first latch part 51' allowing the input digital data D5, . . . , D0 to be sequentially sampled by a shift pulse of the shift register 50; and a second latch part 51" in which when all the samplings are ended, the sampled digital data are transferred by line pass signal at once and stored.

In FIG. 5, "Power" represents a supply voltage, such as Vdd and Vss, and "Control Signal" represents control signals that are used for respective circuit operations. Also, "EN-RGB" represents selection control signals when the digital to analog converter is commonly used for R, G and B.

The most distinctive characteristic of the data driver IC according to the present invention is that a multi-color function is embedded. The multi-color function means a function of converting colors depending on the kinds of displaying images. For example, a moving picture is displayed in a full color mode and a still picture is displayed in an 8 color mode.

In the related art, SRAMs that are embedded in respective pixels. However, as described above, because a number of devices are required to form the memory, apparatuses and processes capable of achieving a simplified design should be substantially provided. Also, although such an LCD can be realized, it cannot be used in the transmission type LCD because, it needs a layout throughout an overall area of the pixel regions.

As noted earlier, the present invention is able to realize the multi-color function, that is, the color conversion function, without using SRAMs. If a still image is displayed, only the most significant bit (MSB) of the inputted digital data is used to achieve the 8 color mode, which generates 2 bits with respect to each red color (R), green color (G) and blue color (B). Thus, most of the driver IC is not used, so that power consumption is reduced greatly.

Operation of the data driver IC of the LCD according to one embodiment of the present invention will now be described.

Figure 6A:
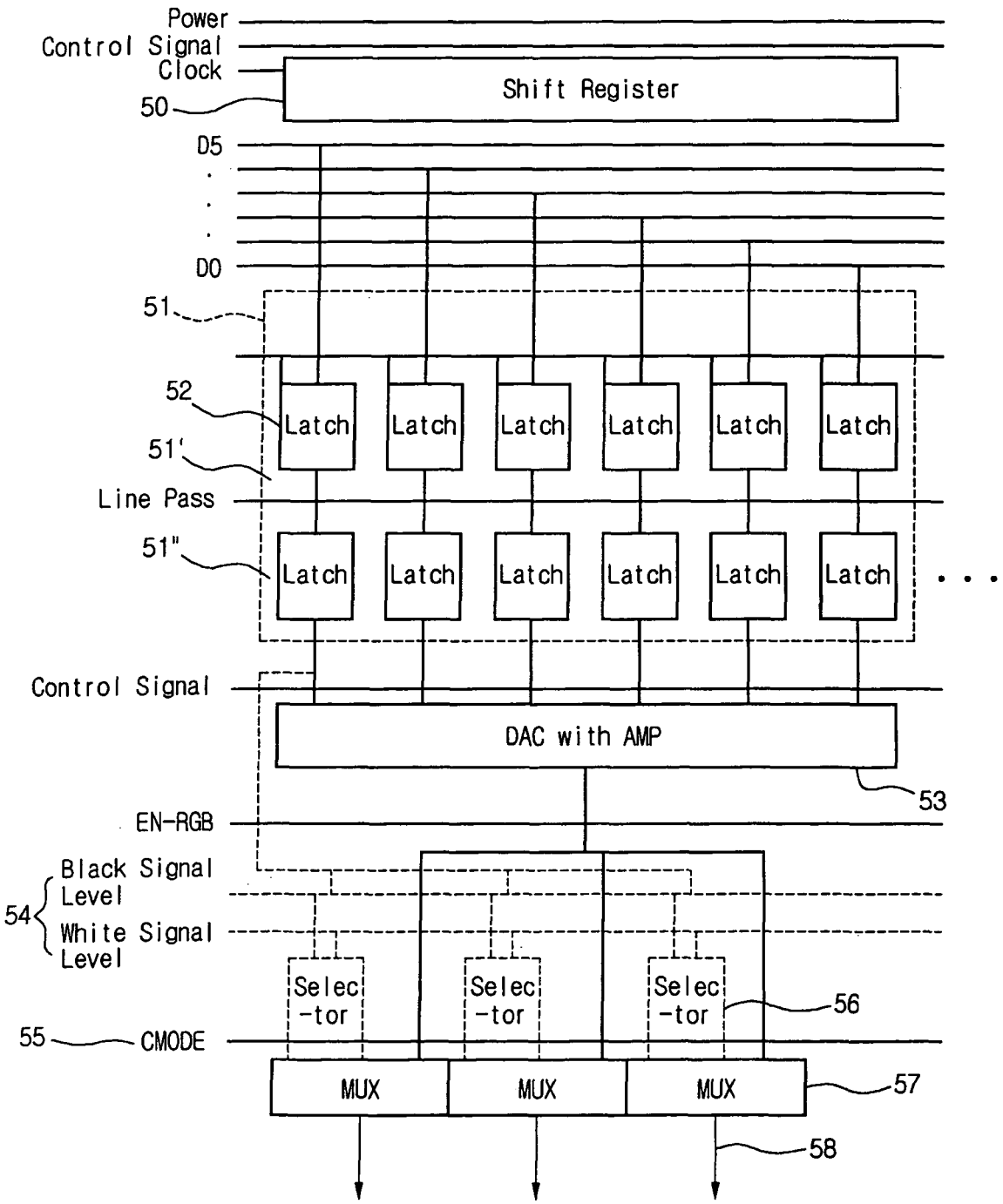
FIGS. 6A and 6B are views illustrating operation of a data driver IC according to the present invention.
Figure 6B:
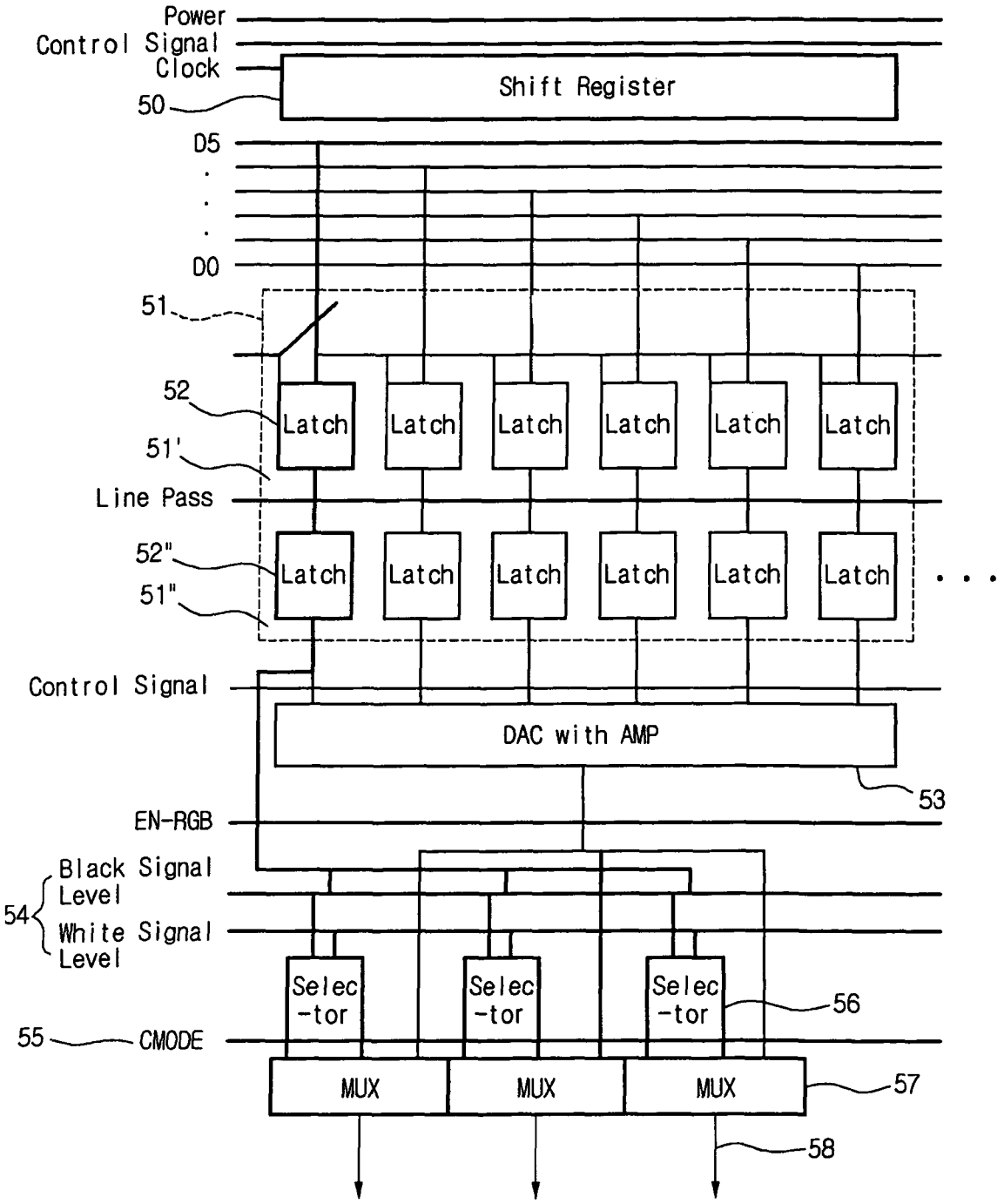

FIGS. 6A and 6B illustrate the operation of the data driver IC according to and embodiment of the present invention.

If the data driver IC is assumed to receive 6-bit digital data, FIG. 6A illustrates a normal mode operation that reproduces 260K colors and FIG. 6B illustrates a mode operation that reproduces 8 colors.

Referring to FIG. 6A, the data driver IC according to the present invention operates in the same manner as the related art data driver IC, for example, when a moving picture is displayed.

In other words, it corresponds to the situation in which a moving picture is displayed in full color (260K colors) by a control signal (color change mode control signal) provided from the color conversion control signal supplying part 55. First, the first latch part 51' allows the digital data inputted from the digital data D5, . . . , D0 input to be sequentially sampled. Once the sampling has ended, the sampled digital data are transferred to the second latch part 51" at once by the line pass signal.

The sampled digital data are converted into analog video signals by the digital-to-analog converter 53 and the analog video signals are amplified by the analog amplifier 53. The amplified analog video signals pass through the multiplexers 57 by the signal of the color conversion control signal supplying part 55 and are supplied to the data lines 58 connected to the respective pixels.

In this circumstance, the analog signal supplying part 54 and the selector 56 are not used.

FIG. 6B illustrates the 8 color mode operation, for example, when a still picture is displayed.

In other words, FIG. 6B illustrates the case of a still picture displayed in 8 colors by a control signal (color change mode control signal) provided from the color conversion control signal supplying part 55. In the data driver IC, only the blocks indicated by the thick solid lines in FIG. 6B are operated.

In other words, only the shift register 50, the predetermined latches 52' and 52", the analog signal supplying part 54, the selector 56, and the multiplexer 57 are operated. Here, the predetermined latches 52' and 52" sample only the most significant bit (MSB) of the input digital data and transfer the sampled MSB to the analog signal supplying part 54 and the selector 56.

When the still picture is displayed in the 8 color by the color conversion control supplying part 55, power is supplied to only the predetermined latches 52' and 52" of the latch part 51 and not to the remaining latches. Thus, even when a still image is displayed, large power consumption can be avoided.

The analog signal corresponding to the black signal level or the analog signal corresponding to the white signal level is selected by the selector depending on whether the sampled MSB digital data is high or low, and then transferred to the multiplexer. As a result, the analog signal is supplied to the data lines 58 that are connected to the respective pixels.

In this case, the digital data are not converted into the analog signals using the digital-to-analog converter and amplifier 53, but the sampled MSB digital data are directly input to the analog signal supplying part 54 and the selector 56. The selector 57 selects and transmits the analog signals corresponding to the black signal level and the white signal level depending on whether the sampled MSB digital data is high or low. Then, the analog signals are transferred to the multiplexer 57 by the signal of the color conversion control signal supplying part 55 and then supplied to the data lines 58 that are connected to the respective pixels.

The analog signals outputted in the two cases (black signal level or white signal level) are displayed in the 8 color (2*2*2=8), corresponding to red, green, or blue.

According to the data driver IC of the present invention, when the still picture is displayed, the power consumption can be reduced greatly without embedding SRAMs as pixel memories into the respective pixels. Further, since SRAM is not used, the data driver IC can be applied without any limitation on the type of LCD display or the product models, such as the transmission type LCD or the like.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A data driver IC of a liquid crystal display comprising:

a shift register for a shift pulse;

a latch part including a plurality of latches, the latches sampling a digital data in accordance with the shift pulse during a full color mode, and one latch of the latches sampling a most significant bit of the digital data in accordance with the shift pulse during a 8 color mode;

a digital-to-analog converter for converting the sampled digital data into an analog signal;

an analog signal supplying part generating first and second analog signals corresponding to a black signal level and a white signal level, respectively;

a color conversion control signal supplying part controlling whether to display the digital data in the 8 color mode or the full color mode;

a plurality of selectors, each of the selectors selecting and outputting one of the first analog signal corresponding to the black signal level and the second analog signal corresponding to the white signal level according to the most significant bit of the digital data; and a multiplexer, responsive to a color conversion control signal from the color conversion control signal supplying part, transferring one of the analog signal selected from each of the selectors and the analog signal converted from the digital-to-analog converter to a corresponding data line, wherein the most significant bit of the digital data from the one latch is directly and simultaneously transferred to all of the selectors, not being passed through the digital-to-analog converter in the 8 color mode, wherein the first analog signal corresponding to the black signal level or the second analog signal corresponding to the white signal level is selected by each of the selectors depending on whether the sampled MSB of the digital data is high or low, and transferred to the multiplexer in the 8 color mode, and wherein a power for operating the latches is only supplied to the one latch and is not supplied the remaining latches of the latches during the 8 color mode.

2. The data driver IC according to claim 1, wherein a moving picture is displayed in the full color mode and a still picture is displayed in the 8 color mode.

3. The data driver IC according to claim 1, wherein when the digital data by the color conversion control signal supplying part is displayed in the 8 color mode, the shift register, the one latch of the latch part, the analog signal supplying part, the selectors, and the multiplexer are operated.

4. The data driver IC according to claim 1, wherein when the digital data by the color conversion control signal supplying part is displayed in the full color mode, the shift register, the latch part, the digital to analog converter, and the multiplexer are operated.

5. A method of driving a data driver IC of a liquid crystal display, comprising:

determining a color mode of an image for digital data;

sampling and storing only a most significant bit (MSB) of the digital data when the color mode is an 8 color mode by using one latch of a plurality of latches in a latch part; and selecting and outputting a first analog signal corresponding to a black signal level or a second analog signal corresponding to a white signal level depending on whether the most significant bit (MSB) is high or low by using a plurality of selectors, wherein the most significant bit of the digital data from the one latch is directly and simultaneously transferred to all of the selectors in the 8 color mode, wherein the first analog signal corresponding to the black signal level or the second analog signal corresponding to the white signal level is displayed in the 8 color mode, and wherein a power for operating the latches is only supplied to the one latch and is not supplied to the remaining latches of the latches during the 8 color mode.

6. The method according to claim 5, wherein the 8 colors generate 2 logic levels with respect to each red color (R), green color (G) and blue color (B).

7. The data drive IC according to claim 1, further comprises an amplifier amplifying the analog signal to be applied from the digital to analog converter to the multiplexer.

* * * * *